US007062366B2

(12) United States Patent
Dussapt et al.

(10) Patent No.: US 7,062,366 B2
(45) Date of Patent: Jun. 13, 2006

(54) METHOD OF CONTROLLING A COMPRESSOR DRIVEN BY THE ENGINE OF A VEHICLE

(75) Inventors: Fabrice Dussapt, Lyons (FR); Armando Carneiro Esteves, Caluire (FR)

(73) Assignee: Rieter Textile Machinery France, Valence Cedex (FR)

( * ) Notice: Subject to any disclaimer, the term of this patent is extended or adjusted under 35 U.S.C. 154(b) by 189 days.

(21) Appl. No.: 10/897,138

(22) Filed: Jul. 22, 2004

(65) Prior Publication Data

US 2004/0260441 A1 Dec. 23, 2004

Related U.S. Application Data

(63) Continuation of application No. PCT/FR03/00421, filed on Feb. 11, 2003.

(30) Foreign Application Priority Data

Feb. 14, 2002 (FR) ..... 02 01834

(51) Int. Cl.
*B60K 25/02* (2006.01)
*B60T 1/10* (2006.01)
*F04B 49/02* (2006.01)

(52) U.S. Cl. ..... 701/36; 701/100

(58) Field of Classification Search ..... 701/1, 701/36, 100
See application file for complete search history.

(56) References Cited

U.S. PATENT DOCUMENTS

| | | | | |
|---|---|---|---|---|
| 4,459,085 | A * | 7/1984 | Tonegawa | 417/282 |
| 5,103,576 | A * | 4/1992 | Cramer et al. | 34/549 |
| 5,951,260 | A * | 9/1999 | Cramer et al. | 417/282 |
| 6,036,449 | A * | 3/2000 | Nishar et al. | 417/292 |
| 6,266,590 | B1 * | 7/2001 | Kutscher et al. | 701/37 |
| 6,292,726 | B1 | 9/2001 | Gustavsson | 701/36 |
| 6,682,459 | B1 * | 1/2004 | Knight | 477/183 |

FOREIGN PATENT DOCUMENTS

| | | |
|---|---|---|
| WO | WO98/07588 | 2/1998 |
| WO | WO00/74990 | 12/2000 |

* cited by examiner

*Primary Examiner*—Michael J. Zanelli
(74) *Attorney, Agent, or Firm*—Heslin Rothenberg Farley & Mesiti P.C.

(57) ABSTRACT

The invention relates to a method of controlling a compressor which is driven by the engine of a vehicle and which supplies at least one compressed air tank. The compressor is activated or de-activated according to a comparison which is made between the value of the pressure in the tank(s) and the pre-determined conjunction and disjunction pressure thresholds, depending on the sign of the engine torque. If the range of torque is positive there are multiple conjunction and disjunction pressure thresholds which are determined according to the vehicle speed estimation or measurement.

6 Claims, 1 Drawing Sheet

METHOD OF CONTROLLING A COMPRESSOR DRIVEN BY THE ENGINE OF A VEHICLE

CROSS-REFERENCE TO RELATED APPLICATIONS

This application is a continuation of international application PCT/FR03/00421 filed on Feb. 11, 2003 and published, in French, as international publication number WO 03/068548, and claims priority from French patent application number 02.01834 filed on Feb. 14, 2002, the complete contents of these applications being incorporated herein by reference.

BACKGROUND OF THE INVENTION

The invention relates to the automotive industry in general, and more specifically to industrial vehicles with braking systems using pneumatic means. The invention is concerned more precisely with a method of controlling the air compressor which is driven by the engine of the vehicle and which supplies the compressed-air reservoir(s). The method according to the invention makes it possible in particular to optimize the production of compressed air notably as a function of the different modes in which the vehicle is operated.

PRIOR ART

Generally speaking, trucks, or industrial vehicles more generally, possess a braking system which utilizes pneumatic energy. The engine thus drives an air compressor which is connected to the engine and which delivers a quantity of compressed air to one or more holding reservoirs. These compressed-air reservoirs in turn supply the brake circuit and other specific circuits performing particular functions. These functions include, for example, the pneumatic suspension devices as; well as auxiliary systems and power-assisted systems for operating the gearbox or clutch system.

Generally speaking, the compressor is controlled by mechanical means connected to the compressor. More specifically, the compressor delivers the compressed air to a regulating and distributing module comprising mechanical and pneumatic components which intervene on the configuration of the pneumatic circuit of the compressor. Specifically, this regulating module is designed so that the compressor stops delivering compressed air when the pressure in the reservoir reaches a predetermined threshold known as the "disconnection threshold". In practice, this disconnection can be obtained by venting the compressor exhaust to atmosphere. In more sophisticated systems, disconnection is achieved by connecting up the compressor inlet and exhaust. Conversely, the compressor starts delivering compressed air again when the pressure in the reservoir reaches a lower threshold termed the "connection pressure". In this case the regulating and distributing module connects the compressor exhaust to the reservoirs. The connection and disconnection thresholds are generally fixed by the construction of the regulating and distributing module, and more specifically by the adjustment of various valves, springs and other cross-sectional ratios.

More advanced systems have already been proposed, particularly that disclosed in document WO 98/07588. More precisely, the mechanism disclosed in that document takes into account a range of vehicle operating parameters to give optimal production of compressed air. Specifically, when the engine brake is on, fuel consumption is zero, and it is then advantageous to use some of the engine braking torque to produce compressed air. Thus, the pressure setpoint, or more precisely the disconnection threshold, applied to the compressor is higher when the engine torque is negative, corresponding to engine braking.

In this way, air production is increased during periods when the power to drive the compressor involves no consumption of fuel. This additional production of air has the advantage that it can be used for mechanical braking in addition to engine braking.

Conversely, when the engine is producing positive torque, the pressure setpoint is set at a lower level in order to limit the fuel consumption. The pressure setpoint is set so in such a way as to produce sufficient compressed air for the braking functions in particular to be carried out correctly.

Apart from the braking system, other systems that operate using pneumatic power include pneumatic suspension systems. The pneumatic suspension system operates in two different ways depending on whether the speed is fast or slow. Specifically, when the speed is slow, the pneumatic suspension system can regulate the height of the chassis. This regulating function necessitates a relatively high pressure in order to give satisfactory response times. Chassis height regulation is not performed at high speed, so the pressure required at high speed is less than the pressure required at low speed.

The object of the invention is to take account of these different modes of operation in order to optimize the setpoint value of the pressure delivered to the compressor.

SUMMARY OF THE INVENTION

The invention therefore relates to a method of controlling a compressor driven by the engine of a vehicle and supplying at least one compressed-air reservoir. The compressor can be started or stopped depending on a comparison between the value of the pressure in the reservoir(s) and various predetermined connection and disconnection thresholds. These predetermined thresholds may depend on the sign of the engine torque in particular.

In accordance with the invention, in the range where the torque is positive, there are multiple connection and disconnection pressure thresholds determined as a function of the measurement or estimate of the speed of the vehicle. In other words, when the vehicle is moving, the pressure delivered by the compressor varies with the speed of the vehicle. The setpoint, that is to say the thresholds at which the compressor is connected and disconnected, are different depending on whether the vehicle is at low or high speed. Thus, the pressure of the air output by the compressor is controlled to within ranges of values which are different depending on the speed and torque of the engine.

In practice, the pressure thresholds can be determined by comparing the speed of the vehicle with a predetermined speed threshold. In other words, when the vehicle is at a speed less than a predetermined threshold, the pressure setpoint range, i.e. the compressor connection and disconnection thresholds, are set at a first pair of values. Conversely, when the vehicle is travelling at a speed greater than the predetermined speed threshold, the connection and disconnection thresholds are set at a different pair of values.

In practice, the pressure thresholds are set at higher values when the speed of the vehicle is less than the predetermined speed threshold. In other words, the pressure delivered by the compressor is higher when the vehicle is travelling at low speed. This enables the reservoir to be supplied at a sufficient pressure for optimal operation of the various systems such as the pneumatic suspension systems controlling the height of the chassis.

Furthermore, the compressor's power consumption is greater at low speed, in which range the heat engine is not running with the throttle wide open, so this additional consumption does not disturb the operation of the vehicle. In this way, the pressure is kept within as high a range of values as possible so as to derive the maximum benefit from the ability to use some of the power of the heat engine without influencing the tractive effort, and thus benefit from the greatest possible amount of stored pneumatic power. Conversely, at high speed, the pressure is kept within a lower range of values, so the consumption of the compressor is slightly reduced, and does not excessively reduce the power available for the tractive function.

In practice, the speed threshold between the two modes of operation of the compressor may advantageously be set as the speed threshold above which the specific function of chassis height control of the pneumatic suspension system is inhibited.

Advantageously in practice, the upper pressure threshold determined when the torque is positive and the speed less than the predetermined speed threshold, may be identical to the upper pressure threshold determined when the torque is negative. In other words, the compressor disconnection threshold may be the same for engine braking periods when energy is being recovered as for periods of low-speed traction.

The invention therefore also relates to a device for regulating a compressor driven by the engine of a vehicle and supplying one or more compressed-air reservoirs.

Such a device comprises:

means for starting or stopping the compressor depending on a comparison between the value of the pressure in the reservoir(s) and various predetermined thresholds;

means for measuring the pressure in the reservoir(s);

means for measuring or evaluating the sign of the torque of the engine;

means for varying the predetermined pressure thresholds.

In accordance with the invention, the device also comprises means for evaluating or estimating the speed of the vehicle, and means for varying the predetermined pressure thresholds in the range in which the engine torque is positive.

In practice, the various predetermined pressure thresholds are regulated by software. An electronic control unit regulates and controls the compressor and is informed of the speed of the vehicle and of the engine torque so that the thresholds can be regulated in accordance with the invention.

BRIEF DESCRIPTION OF THE DRAWINGS

The manner in which the invention is carried out, and the advantages procured thereby, will become clearer in the course of the description of the following embodiment, with the support of the attached figures in which.

REALIZATION OF THE INVENTION

Figure 1:
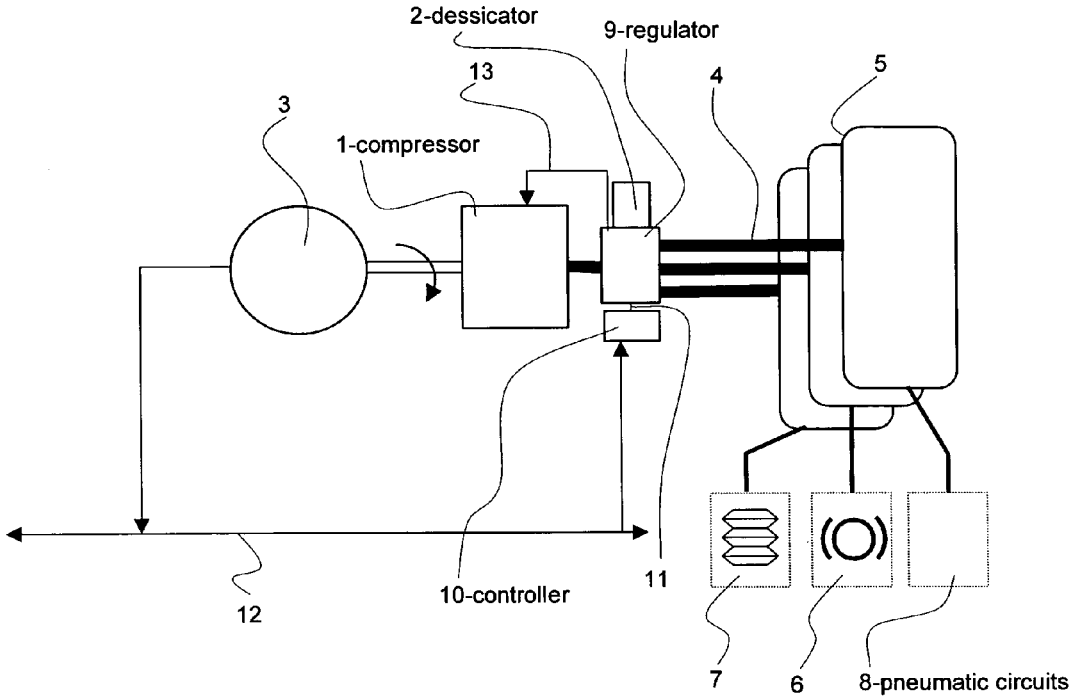
FIG. 1 is a diagram illustrating the various components used in the method according to the invention.

FIG. 1 shows a particular but non-restricting example of an embodiment using the method according to the invention. Identifiable in this FIG. 1 is the compressor (1) which delivers the compressed air to a regulating and distributing module (9) on which the desiccator cartridge (2) is mounted. This compressor (1) is driven by the engine (3). The interaction between the regulating module (9) and the compressor (1) is represented by the arrow (13). The configuration of the pneumatic circuit connected to the compressor, and in particular the action on the compressor exhaust, is brought about by various means of control, which may be pneumatic or electrical in particular.

The regulating and distributing module (9) delivers compressed air via the lines (4) to one or more reservoirs (5), which may vary in number to suit the vehicle, without departing from the scope of the invention. These reservoirs (5) are connected to different circuits shown diagrammatically. Possible examples are the brake circuit (6), the supply circuit of the pneumatic suspension system (7), or the compressed-air supply to the trailer. The reservoirs may also supply other pneumatic circuits (8) performing different functions, of which the parking brake and various different auxiliary systems connected to the gearbox or clutch mechanism may be mentioned.

Mention may also be made of the systems running on pneumatic power, motion take-off or force take-off systems, or the inter-wheel or inter-axle differential locking system, or that for the transfer box. This list is of course not exhaustive.

In accordance with the invention, the compressor (1) is controlled via an electronic control unit (10), which may be a completely autonomous item, doing nothing except manage and operate the compressor, but which may also be integrated into a more over-arching system for the electronic management of other functions within the vehicle. In the form illustrated, the electronic control unit is flange-mounted to the regulating and distributing module (9). However, the electronic control unit may also be geographically remote from the module (9).

In the form illustrated, this electronic control unit has several electrical outputs (11) carrying electrical signals to the compressor (1). These two electrical outputs inform the compressor of the pressure threshold levels corresponding to the compressor disconnection and connection thresholds. However, other forms of communication between the compressor and the control unit (10) may be envisaged. For example, the pressure thresholds corresponding to the different modes of operation may be programmed into the compressor by mechanical constructional arrangements. The control unit may inform the compressor of the current regulating mode, thus sending binary information between the control unit (10) and the compressor (1). Communication between the electronic control unit and the regulating module (9) is not limited to exchanging electrical signals as the invention also covers variants using pneumatic or other signals.

In the form illustrated, the vehicle comprises a data bus (12) on which information is exchanged by the control units present in the vehicle. For example, information about the speed and about the sign of the torque of the engine (3) can be carried by this bus (12) to the control unit (10) which in turn regulates the compressor (1).

The reservoirs (5) are designed to work up to stabilized pressures of around 12.5 bar. The pneumatic energy requirements of the various compressed-air consuming items are variable. For example, the brake circuit of the various axles of the trailer usually runs at a pressure of around 8.5 bar maximum. The pneumatic suspension system (7) runs at a maximum pressure of around 12.5 bar. This pressure is required to run the suspension system for controlling the height of the chassis, also known as the "lift and lower" chassis system.

One particular use of this function is when connecting the trailer and levelling it up to a cargo handling bay. This function of controlling the height of the chassis is inhibited when the vehicle is moving at a speed greater than a predetermined threshold, typically of around 10 km/h. Above that speed, the pneumatic suspension system controls the height within a small amplitude, and an air pressure of less than 10 bar is then sufficient.

Among the other systems using the pneumatic power, the various auxiliary systems generally run at maximum pressures of around 8.5 bar. The supply of compressed air to the trailer is also at a pressure of around 8.5 bar.

Figure 2:
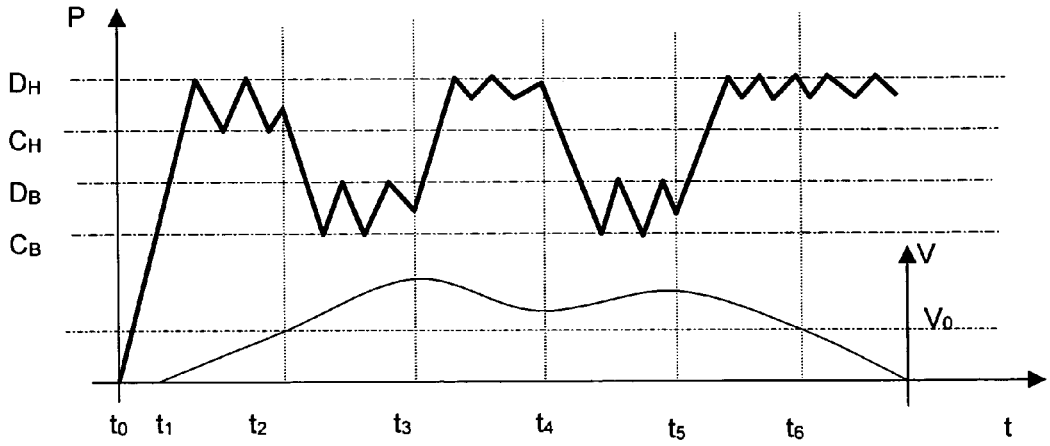
FIG. 2 is a diagram illustrating the speed and the pressure delivered by the compressor against time, as a function of the different phases of operation.

The operation of the compressor in accordance with the invention can be understood with the aid of FIG. 2 which shows the changes in the various setpoint thresholds applied to the compressor based on the phases of operation.

Thus, when the engine starts up, denoted instant $t_0$, the reservoir (5) is at atmospheric pressure, and the overpressure is 0 bar. The vehicle is at rest and the engine torque is positive, so the compressor is controlled in such a way that the pressure thresholds are relatively high. More precisely, the compressor is driven in such a way that the pressure can rise to the upper disconnection value ($D_H$) of around 12.5 bar. As soon as the pressure reaches ($D_H$), the compressor is disconnected.

After this disconnection a phase of regeneration of the desiccator cartridge (2) is triggered automatically. This regeneration consumes a quantity of compressed air which results in a slight reduction in the pressure. Depending on how much air is consumed by the various systems (6, 7, 8), the pressure continues to decline slightly. As soon as the pressure reaches the lower threshold, corresponding to the disconnection threshold, the compressor is then restarted, so that the pressure rises again.

This "low-speed" mode of operation continues after the vehicle has started, corresponding to instant $t_1$, as long as the speed remains less than the predetermined threshold $V_0$.

At instant $t_2$, when the speed exceeds the $V_0$ threshold, the pressure thresholds are then automatically modified ($D_B$, $C_B$) corresponding to a "high-speed" mode of operation. The pressure is then regulated in a similar way to that discussed above, within the range defined between the two values $D_B$ and $C_B$.

Thereafter, at instant $t_3$, the engine torque becomes negative, corresponding to a period of braking using the engine brake. The fuel injection rate is zero. The electronic control unit (10) analyzes this information and modifies the pressure regulating thresholds accordingly to run the compressor in "energy recovery" mode. The new pressure setpoint is set at a value $D_H$ corresponding to the disconnection threshold for the "low-speed" mode described above. However, this pressure setpoint could be set at a different value without departing from the scope of the invention. For example, when the pressure reaches this upper threshold $D_H$, the compressor is disconnected during the period of regeneration of the desiccator cartridge (2). The compressor is then restarted to bring the pressure up to the upper threshold $D_H$ and this continues as far as the system is in "energy recovery" mode.

The pressure in the air reservoir is then maintained at a maximum level without the engine consuming any fuel. It will be observed that, advantageously, the power drawn by the compressor helps to slow the vehicle down. During this engine braking phase the various pneumatic systems (6, 7, 8) may consume compressed air, lowering the pressure in the reservoirs (5).

At instant $t_4$, the engine torque once again becomes positive. Since the speed of the vehicle is greater than the predetermined threshold $V_0$, the compressor operates in the so-called "high-speed" mode described above.

Beginning at instant $t_5$, the vehicle is using the engine brake until it stops. The compressor is then controlled in the "energy recovery" mode described above. There is no effect when the speed of the vehicle drops below the predetermined threshold $V_0$ because the torque remains negative.

It will be clear from the foregoing that the method of control in accordance with the invention has many advantages, notably:

- it reduces the fuel consumption linked to the generation of pneumatic power by optimizing the phases during which the compressor is required to work;
- it improves the functions of storage and distribution of compressed air to the various consumer components with which the vehicle is fitted;
- it ensures that these consumer components have adequate air pressure; and
- it increases the service life of the components involved in the compressed air control system, particularly the desiccator cartridge.

What is claimed is:

1. A method of controlling a compressor driven by an engine of a vehicle and supplying at least one compressed-air reservoir, wherein the compressor is started or stopped depending on a comparison between a value of pressure in the at least one reservoir and various predetermined connection and disconnection pressure thresholds, depending on a sign of engine torque, and wherein, in a range where the torque is positive, there are multiple connection and disconnection pressure thresholds determined as a function of measurement or estimate of the speed of the vehicle.

2. The method as claimed in claim 1, wherein, in the range in which the torque is positive, the pressure thresholds are determined by comparing the speed of the vehicle with a predetermined speed threshold.

3. The method as claimed in claim 2, wherein in the range in which the torque is positive, the pressure thresholds are higher when the speed of the vehicle is less than the predetermined speed threshold.

4. The method as claimed in claim 1, wherein an upper pressure threshold determined when the torque is positive and the speed less than a predetermined speed threshold, is identical to an upper pressure threshold determined when the torque is negative.

5. A device for regulating a compressor driven by an engine of a vehicle and supplying at least one compressed-air reservoir, comprising:

- means for starting or stopping the compressor depending on a comparison between a value of pressure in the at least one reservoir and various predetermined connection and disconnection pressure thresholds;
- means for measuring the pressure in the at least one reservoir;
- means for measuring or evaluating a sign of torque of the engine;

means for varying the predetermined pressure thresholds; and means for evaluating or estimating speed of the vehicle, and means for varying the predetermined connection and disconnection pressure thresholds in a range in which the torque is positive.

6. The device as claimed in claim 5, wherein means for varying the predetermined pressure thresholds in the range in which the torque is positive are built into a computer program.

* * * * *

UNITED STATES PATENT AND TRADEMARK OFFICE

CERTIFICATE OF CORRECTION

PATENT NO. : 7,062,366 B2
APPLICATION NO. : 10/897138
DATED : June 13, 2006
INVENTOR(S) : Dussapt et al.

It is certified that error appears in the above-identified patent and that said Letters Patent is hereby corrected as shown below:

On the title page, item:

(75) Inventors:

Delete "Lyons" and insert --Lyon--

(73) Assignee:

Delete "Rieter Textile Machinery France, Valence Cedex (FR)" and insert --Renault V.I., Saint Priest, (FR)--

Claims:

Claim 6

Col. 8, line 1, insert the word --the-- after the word "wherein"

Signed and Sealed this

Ninth Day of October, 2007

JON W. DUDAS
*Director of the United States Patent and Trademark Office*